United States Patent [19]

Manders

[11] 4,332,280

[45] Jun. 1, 1982

[54] AIR SUPPLY SYSTEM FOR A PNEUMATIC LOOM

[75] Inventor: Petrus G. J. Manders, Eindhoven, Netherlands

[73] Assignee: Ruti-Te Strake B.V., Deurne, Netherlands

[21] Appl. No.: 211,102

[22] Filed: Nov. 28, 1980

[30] Foreign Application Priority Data

Dec. 21, 1979 [CH] Switzerland ..... 11392/79

[51] Int. Cl.[3] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 4,102,361 | 7/1978 | Tanaka et al. | 139/435 |
| 4,187,888 | 2/1980 | Van Mullekom | 139/435 |
| 4,212,330 | 7/1980 | Van Dork et al. | 139/435 |

*Primary Examiner*—Henry Jaudon

*Attorney, Agent, or Firm*—Werner W. Kleeman

[57] ABSTRACT

An air supply system for a pneumatic loom contains a pressurized or compressed air container connected by means of a primary valve with a pressure line or conduit. There are also provided a primary blowing nozzle and auxiliary blowing nozzles connected by means of a respective control valve with the compressed air container or reservoir. There is further provided a compressed air storage which, during standstill of the loom or weaving machine, is connected with the pressure line or conduit and, during the starting phase of the loom, is connected forwardly of the pressurized or compressed air container. In this way upon start-up of the loom the compressed air container is supplied with compressed or pressurized air by the compressed air storage, causing an extremely rapid build-up of pressure in the compressed air container.

4 Claims, 2 Drawing Figures

AIR SUPPLY SYSTEM FOR A PNEUMATIC LOOM

BACKGROUND OF THE INVENTION

The present invention relates to a new and improved construction of an air supply system for a pneumatic loom or weaving machine.

Generally speaking, the air supply system for a pneumatic loom of the present development is of the type comprising a compressed air container or reservoir connected by means of a primary or main control valve with a pressure line or conduit and, furthermore, contains a primary blowing or blower nozzle and a number of auxiliary blowing or blower nozzles. The auxiliary blowing nozzles are each connected by means of a control valve with the pressurized or compressed air container.

In an air supply system of this type, as disclosed in U.S. Pat. No. 4,187,888, the compressed air container, during operation of the loom, is directly connected by means of the primary control valve with the pressure line, while during standstill of the loom it is not so connected. Therefore, each time that the loom is started there again must be built-up the requisite pressure within the compressed air container. Particularly in the case of large size pressurized or compressed air containers for wide looms there can arise the problem that this pressure build-up does not occur with the desired rapidity.

It would be possible to solve this problem by appropriately largely dimensioning the infeed line leading to the compressed air container, but this would require a considerable modification of the air supply system, which only would be necessary for looms greater than a certain width, and thus, would be uneconomical. Additionally, the aforementioned dimensioning of the system, if such dimensioning is to be optimum, must be altered for each width change of the related loom.

SUMMARY OF THE INVENTION

Therefore with the foregoing in mind it is a primary object of the present invention to provide an improved construction of air supply system for a pneumatic loom which is not afflicted with the aforementioned drawbacks and limitations of the prior art.

Another and more specific object of the present invention is to structure an air supply system for a pneumatic loom in a manner such that the pressure build-up in the compressed air container or reservoir occurs with the requisite rapidity upon start-up of the loom, without there being needed any appreciable alterations or modifications in the air supply system.

Another important object of the invention is to provide an air supply system for a pneumatic loom which can be accommodated in a most simple fashion to changing widths of the looms.

Now in order to implement these and still further objects of the invention, which will become more readily apparent as the description proceeds, the air supply system of the present development is manifested by the features that a compressed air storage is provided which, during standstill of the loom, is connected with the pressure line or conduit and during the starting phase of the loom is connected forwardly of the compressed air container.

The inventive compressed air storage is therefore filled with pressurized or compressed air during the standstill times of the loom and during start-up of the loom always fills the compressed air container, so that the pressure build-up in the compressed air container can be accomplished appreciably more rapidly than was heretofore the case. The accomodation of the system to varying loom widths can be accomplished by simply selecting a compressed air storage of suitable dimension.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
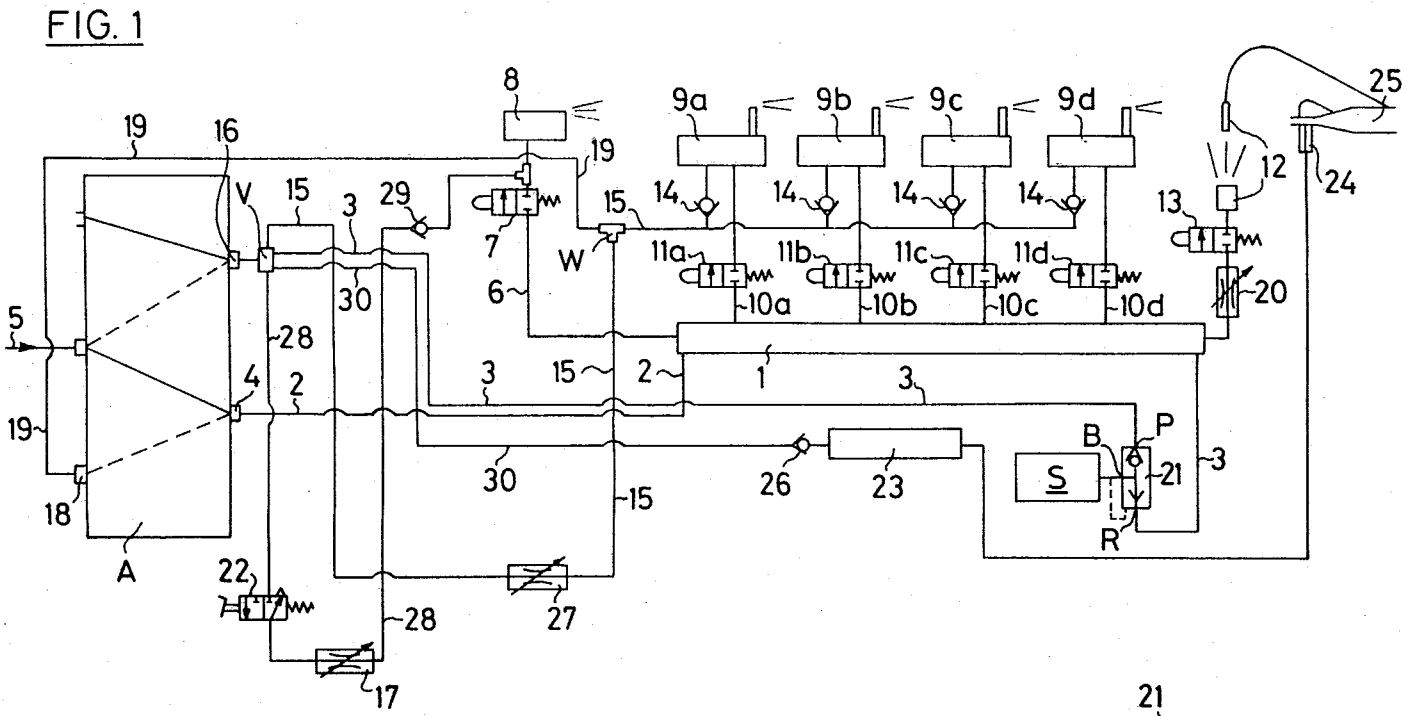
FIG. 1 schematically illustrates a preferred embodiment of air supply system for a pneumatic loom according to the invention.

Describing now the drawings in FIG. 1, reference character 1 designates a pressurized or compressed air container which is connected by means of a line or conduit 2 with a connection 4 of a primary control valve A and is also connected by means of a line or conduit 3 with a distributor block or means V. The distributor block V is connected on the one hand with a further connection 16 of the primary or main control valve A. In the operating position indicated with solid or full lines the primary or main control valve A constitutes the connection between the line or conduit 2 and a compressed air line or conduit 5. A primary or main blowing nozzle 8 is connected with the compressed air container 1 by means of the connection line 6 and a valve 7 arranged in the connection line 6 and which valve is controlled by the loom. Furthermore, a number of auxiliary blowing or blower nozzles or groups of auxiliary blowing or blower nozzles 9*a*, 9*b*, 9*c*, 9*d* are connected with the compressed air container 1 by means of branch lines or conduits 10*a*, 10*b*, 10*c*, 10*d*. In each branch line 10*a*, 10*b*, 10*c*, 10*d* there is arranged a valve 11*a*, 11*b*, 11*c*, 11*d*, respectively, controlled by a cam of a standard weaving machine-controlled cam shaft. This part of the equipment may be constructed, for instance, in the manner preferably disclosed in U.S. Pat. No. 4,212,330. Reference numeral 12 designates a tensioning nozzle which is arranged at the end of the path of travel of the weft thread or filling which moves in standard fashion through the shed of the loom, and which likewise is connected by means of a loom-controlled valve 13 and the pressure reduction valve 20 with the compressed or pressurized air container 1. A tensioning nozzle 12 of such type has been disclosed, for instance, in the U.S. Pat. No. 4,096,889, to which reference may be readily had.

The primary blowing or blower nozzle 8 and the auxiliary blowing or blower nozzles or groups of blowing or blower nozzles 9*a*, 9*b*, 9*c*, 9*d* are additionally each connected by means of a check or non-return valve 14 or equivalent structure with a first auxiliary supply line or conduit 15, which, in turn, is connected by means of the distributor block V with the connection 16 and, on the other hand, by means of a branch portion W and an auxiliary line 19 with a connection 18 of the primary control valve A. In the position of the primary or main control valve A shown with broken lines, the first auxiliary supply line or conduit 15 is connected by means of the connection 16 with the pressure or compressed air line 5, and specifically, by means of a pressure reduction valve 27, whereas the compressed air container or reservoir 1 can vent to the pressure in the first auxiliary supply line 15 by means of the connection 18 of the primary control valve A and the auxiliary line or conduit 19.

Figure 2:
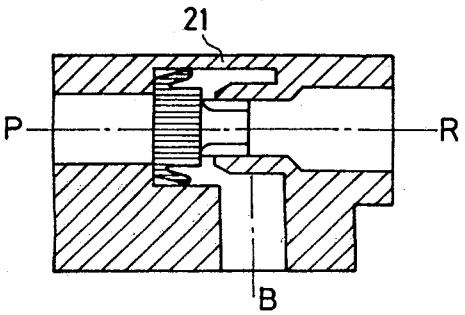
FIG. 2 illustrates in fragmentary sectional view a detail of the arrangement of FIG. 1.

Incorporated into the line or conduit 3 is a valve 21 which is connected with a pressurized or compressed air storage S, by means of which the compressed air storage S can be selectively connected during loom standstill with the distributor block V or upon start-up of the loom with the compressed air container 1. The valve 21 can be electrically controlled, or as indicated in the drawings, it can be a so-called pneumatically controlled rapid vent valve, as particularly shown in FIG. 2. Such is constituted by a blocking valve having two inlets P and B and a vent connection R. The inlet P is connected with the distributor block V, the inlet B with the compressed air storage S and the vent connection R is connected with the compressed or pressurized air container 1. When air is infed to the inlet P when there exists a flow connection from the inlet P to the inlet B and the vent connection R is closed, whereas when air is infed from the inlet B there is present a flow connection from the inlet B to the vent connection R and the inlet P is closed.

In the standstill condition of the loom, represented by the phantom or broken line position of the primary control valve A, there prevails, when the standard pressurized or compressed air source is switched-on, within the rapid vent valve 21 the infed air received from the inlet P. Consequently, the vent connection R is blocked and the compressed or pressurized air storage S is filled with compressed or pressurized air by means of the connection 16, the distributor block V, the line or conduit 3 and the rapid vent valve 21. The auxiliary blower or blowing nozzles *9a, 9b, 9c, 9d* are supplied with compressed or pressurized air at reduced pressure by the first auxiliary supply line or conduit 15 by means of the connection 16 and the pressure reduction valve 27. Additionally, at the distributor block V there is connected a second auxiliary supply line 28 which leads to the primary blower nozzle 8 by means of a pressure reduction valve 17 and a check valve 29. Between the distributor block V and the pressure reduction valve 17 there is furthermore arranged in the second auxiliary line 28 a blocking valve 22, which can be randomly opened, for instance through footactuation thereof, for supplying the primary blowing nozzle 8 with pressurized air, likewise by means of the connection 16. The blocking valve 22 only serves for threading a weft thread into the primary blower nozzle 8 and otherwise is always closed, so that the supply of the primary blower nozzle 8 in the normal case is accomplished through the nozzle 7 from the compressed air container 1.

During this standstill time of the loom the tensioning nozzle 12 is not impinged with air, rather there is supplied with air by means of the connection 16 and the line 30 and check valve 26 a further compressed air storage 23 by means of which there is supplied a so-called start or starting nozzle 24, for instance of the type described in the previously mentioned U.S. Pat. No. 4,096,889, which ensures that the head or leading end of the first weft or filling thread, following start-up of the loom, will be placed with certainty at the suction mouth 25 of the start or starting nozzle 24.

Upon start-up of the loom, represented by the full line position of the primary or main valves A, there is present in the rapid vent valve 21 the infed air delivered from the inlet B, so that the contents of the compressed air storage S can empty into the compressed air container 1 by means of the vent connection R. This causes, in turn, an extremely rapid pressure build-up in the compressed air storage 1. The pressurized or compressed air required, following the starting phase of the loom, for the insertion of the weft thread is received by the pressurized or compressed air container 1 by means of the connection 4 and the line or conduit 2.

Practical tests have shown that the compressed air storage S provides a further positive action in that, namely, due to the use thereof pressure fluctuations within the compressed air container 1 are reduced to a fraction of their prior values.

The primary blowing nozzle 8 need not, as illustrated, be supplied by the compressed air container 1, rather could for instance also be directly connected with the connection 4.

While there are shown and described present preferred embodiments of the invention, it is to be distinctly understood that the invention is not limited thereto, but may be variously embodied and practiced within the scope of the following claims. Accordingly,

What I claim is:

1. An air supply system for a pneumatic loom, comprising:

a compressed air container;

a primary control valve;

a pressure line;

said primary control valve connecting said pressure line with said compressed air container;

a primary blower nozzle and a number of auxiliary blower nozzles;

control valve means for operatively connecting said auxiliary blower nozzles with said compressed air container; and compressed air storage means which, during standstill of the loom, is connected with the pressure line and during the starting phase of the loom is connected forwardly of the compressed air container.

2. The air supply system as defined in claim 1, further including:

an air supply line for connecting the compressed air container with the pressure line;

means for operatively connecting the compressed air storage means with said air supply line and with said compressed air container so as to assume two operative conditions;

said operatively connecting means in one of said operative conditions establishing a flow connection between said air supply line and said compressed air storage means and in said other operative condition there is established a flow connection between said compressed air storage means and said compressed air container.

3. The air supply system as defined in claim 2, wherein:

said means for establishing said operative connection between the air supply line and said compressed air storage means comprises a rapid vent valve;

said rapid vent valve having two inlets and an air vent outlet connection;

both of said inlets of said rapid vent valve being respectively connected with said air supply line and with said compressed air storage means and said vent connection being connected with said compressed air container.

4. The air supply system as defined in claim 2, wherein:

said means for establishing said operative connection between said air supply line and said compressed air storage means comprises an electrically controlled valve.

* * * * *